US005482193A

United States Patent [19]

Fuchs

[11] Patent Number: 5,482,193

[45] Date of Patent: Jan. 9, 1996

[54] DISPENSER FOR MEDIA

[75] Inventor: Karl-Heinz Fuchs, Radolfzell, Germany

[73] Assignee: Ing. Erich Pfeiffer GmbH & Co. KG, Radolfzell, Germany

[21] Appl. No.: 228,178

[22] Filed: Apr. 15, 1994

Related U.S. Application Data

[63] Continuation of Ser. No. 973,868, Nov. 9, 1992, abandoned.

[30] Foreign Application Priority Data

Nov. 8, 1991 [DE] Germany ..... 41 36 826.6

[51] Int. Cl.[6] ..... B05B 11/06

[52] U.S. Cl. ..... 222/633; 222/541.3; 222/541.6

[58] Field of Search ..... 222/212, 95, 494, 222/541, 630–633, 637, 541.3, 541.6; 239/490, 492, 494

[56] References Cited

U.S. PATENT DOCUMENTS

| | | | |
|---|---|---|---|
| 2,718,987 | 9/1955 | Kimball | 222/633 |
| 4,469,254 | 9/1984 | Hansen | 222/541 X |
| 4,512,475 | 4/1985 | Federighi | 222/541 X |
| 4,979,678 | 12/1990 | Ruscitti et al. | 239/492 X |
| 5,121,856 | 6/1992 | Weiler et al. | 222/541 X |
| 5,215,221 | 6/1993 | Dirksing | 222/633 X |

FOREIGN PATENT DOCUMENTS

| | | | |
|---|---|---|---|
| 1484407 | 6/1967 | France | 222/633 |

*Primary Examiner*—Gregory L. Huson
*Attorney, Agent, or Firm*—Quarles & Brady

[57] ABSTRACT

A media dispenser (2) has a discharge head (3), a medium chamber (30) holding a volume of medium filled under pressure, and a hand-operable propellant pump (5). By manual compression of the balloon-like pressure chamber (6) comprising film portions (13, 14), propellant is conveyed into the medium chamber (30), with pressure sufficient to cause the opening of a valve (26), and delivery of a mixture of medium and propellant through an atomizing nozzle (21). The nozzle (21) is tightly closed by a closure (39) connected to a common carrier (40) for a plurality of the dispensers (2). The carrier (40) has interruptible connections to the head (3) which can be interrupted to remove closure 39 and open atomizing nozzle 21.

35 Claims, 2 Drawing Sheets

DISPENSER FOR MEDIA

This application is a continuation, of application Ser. No. 07/973,868, filed Nov. 9, 1992, now abandoned.

BACKGROUND OF THE INVENTION

The invention relates to a discharge apparatus for media, which is suitable for the ultra-fine atomization of liquid, pulverulent or similar media, as well as for portable use and one-handed operation.

The discharge apparatus uses a propellant pump to deliver a propellant with which the medium can be discharged from one or more medium chambers or reservoirs. The propellant and medium are discharged in the direction of one or more outlet openings. The discharges reduces the volume of one or more pressure chambers. The medium in the pressure chamber can be the same medium or have the same aggregate state as that in the medium chamber. Preferably, however, said media are different as regards their aggregate states. For example, the propellant can be any suitable gas, such as air, whilst the propelled or driven medium can be a pharmaceutical or cosmetic agent that is at least partly liquid and/or pulverulent.

The two media do not chemically react with one another and instead only form mixtures. The volume of the propellant to be discharged per operating stroke is one to three powers greater than the volume of active substance to be discharged during said stroke. The total storage volumes of the pressure chamber and medium chamber may be almost completely emptied during one operating stroke. As a result of these constructions, which are according to the invention, a discharge apparatus with operational advantages is provided.

An object of the invention is to provide a discharge apparatus of the aforementioned type in which disadvantages of known discharge apparatuses are avoided and which in particular makes it possible, in the case of a very simple construction, to discharge very small active substance quantities in their most finely divided form.

SUMMARY OF THE INVENTION

According to the invention, at least one driving or propellant pump is constructed as a bellows pump, and at least one part of at least one medium chamber is connected to at least one outlet opening in such a way that the propellant delivered by said pump to an effective emptying of the active substance from the medium chamber. The active substance is finely divided in a propellant flow and is then conveyed to the outside with the propellant along a discharge channel or passage and through an outlet opening which functions as an atomizing nozzle.

As a result of the construction according to the invention, it is possible to apply active substance quantities in finely divided form of less than 1/10 or 1/30 l $cm^3$ with a propellant volume that is over 100 times greater, for example, approximately 5 $cm^3$.

The pressure chamber can be constructed with an inlet valve to allow refill after a first operation. Preferably, at least one chamber is prefilled for a single use or single discharge operation. Thus, a pressure chamber can be completely closed in its initial or starting state and then filled under pressure. Even with a chamber of small dimensions, a relatively large propellant volume can be obtained. The composition or degree of purity of this propellant volume can be precisely determined.

In operating the dispenser, the volume of propellant is forced out of the pressure chamber by overcoming the resistance of a closure blocking the pressure chamber outlet. The propellant is reliably stored for a substantial time and cannot gradually escape. This closure can be formed in substantial part by the active substance, if the medium chamber forms a part of the outlet channel of the pressure chamber, and provided the medium substantially tightly seals the medium chamber or completely fills it as a dense packing. Thus, contrary to what would also be conceivable, there is no need for a pressure-dependent operating valve or an opening inlet valve between the pressure chamber outlet and the medium chamber inlet. Instead, the medium chamber inlet is always open to the propellant pump pressure chamber. The outlet-side medium chamber end is associated with the outlet opening or a portion of the outlet channel connected thereto. The outlet side medium chamber can be closed with a pressure-dependent operating closure, which secures both the pressure chamber and the medium chamber against unintentional emptying unless it is correctly opened.

According to the invention there is also a casing of substantially stable dimensions that has an outlet opening and may include the medium chamber. The casing is appropriately connected in articulated manner to the propellant pump or with remote pressure handles positioned around at least one joint or articulation axis for actuating a discharge. This joint or articulation axis is positioned transverse to its central axis or to that of the outlet opening and preferably intersects said central axis at right angles. Thus, for simplifying the handling during discharge and/or for obtaining a compact storage state, the casing can be oriented in different angular positions with respect to said components. Preferably, the casing is limited to most easily pivot around a single defined joint axis, which connects two link portions of the discharge apparatus. The two link portions project freely from the axis and are positioned transversely to the actuating direction of the handles.

The propellant pump is formed by a cushionlike bellows formed from superimposed films tightly connected in marginal areas on the pressure chamber circumference. The film parts of the bellows constitute the sole connection between the casing and the pressure chamber. The two spherical, equally large walls of the pressure chamber form the handles for actuating the discharge apparatus. These walls are roughly the same size as the ball of a thumb. This provides for ergonomic handling and for nearly complete emptying of the pressure chamber under high pressure.

Several individual discharge apparatuses can be joined to a common carrier in a non-destructive manner. The individual discharge apparatuses are arranged in succession in a single row or can be arranged in a multirow grid. The handles of adjacent discharge apparatuses are oriented in a common plane. The closure for the outlet opening can be formed either as part of the carrier or as a separate component, so that the discharge apparatus is only freed when the closure has been removed by manual gripping and opening.

Other objects and advantages, besides those discussed above, will be apparent from the description of the preferred embodiment which follows. In the description, reference is made to the accompanying drawings, which form a part hereof, and which a preferred embodiment of the invention. Such embodiment, however, is not exhaustive, and individual features, either singly or in the form of subcombinations, can be realized in an embodiment of the invention and in other fields and represent advantageous, independently protectable constructions for which protection is hereby claimed in the claims which follow the description.

DETAILED DESCRIPTION OF A PREFERRED EMBODIMENT

Figure 1:
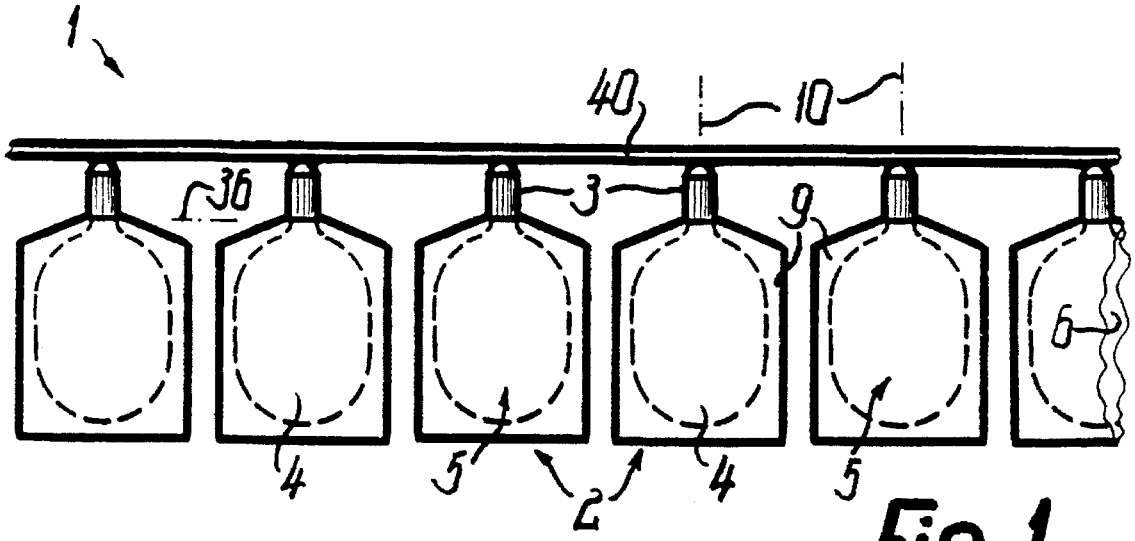
FIG. 1 is an elevational view of a plurality of apparatuses constructed according to the present invention.
Figure 2:
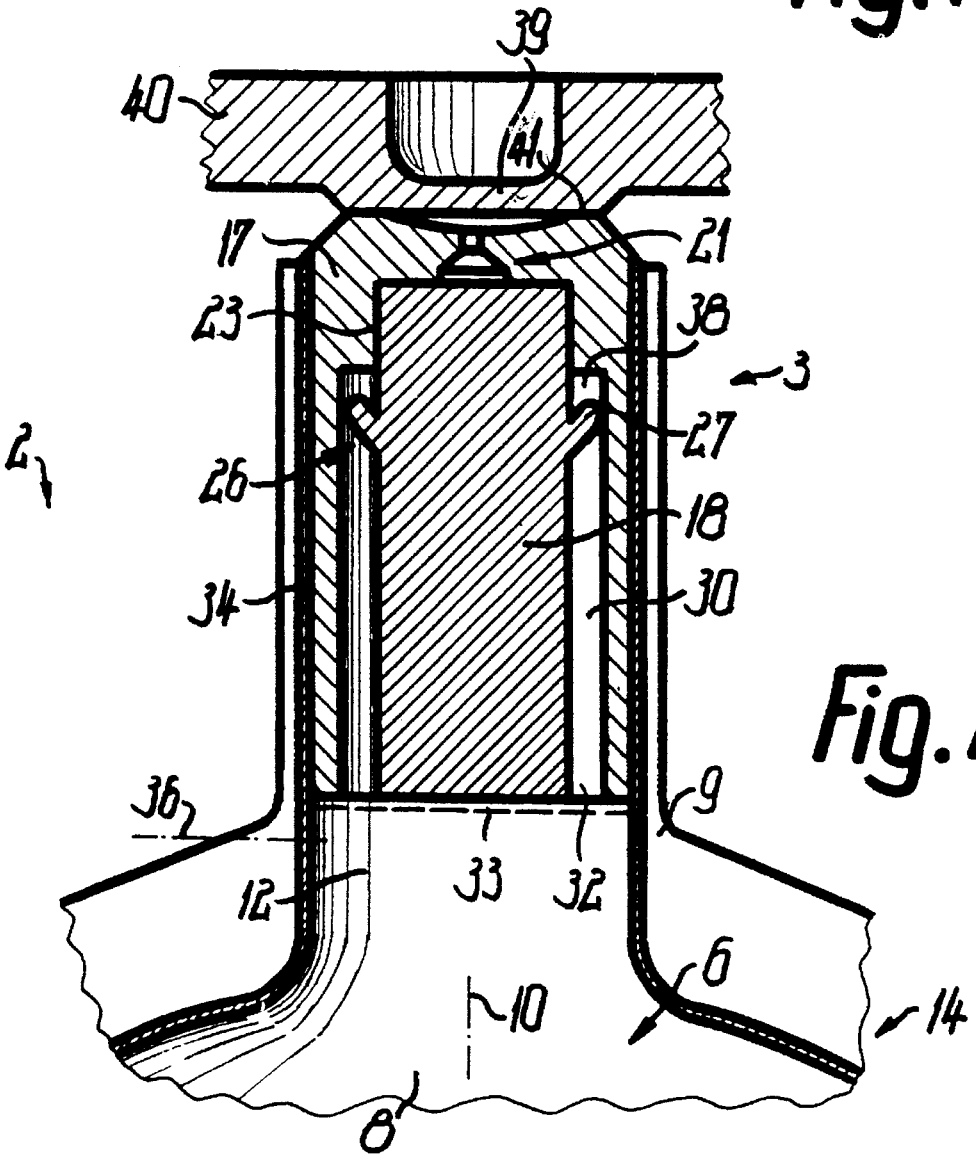
FIG. 2 is an enlarged detail view in section of a single discharge apparatus according to FIG. 1.

The discharge apparatus set 1 according to FIG. 1 has a plurality of discharge apparatuses 2, which can be the same or different, which can be removed independently of one another and can only be operated in such a way that a medium discharge takes place. The discharge apparatuses 2 can be of the same or different size, filling volume or fillers, whichever use is intended for the set 1. The discharge apparatuses 2 succeed one another in a straight line, but could also be arranged in a ring form. At least parts of adjacent discharge apparatuses 2 are freely movable against one another in the set 1, particularly at right angles to their connection lines or their common plane. Adjacent discharge apparatuses 2 are not in contact with one another, but are instead spaced by gaps and are only connected on one side or face to a common carrier from which they freely project.

The discharge apparatus 2 has a dimensionally stable, elongated casing 3, whose outer circumference is smooth-surfaced or cylindrical in continuous manner substantially over its entire length. The casing 3 is located at the end of a grip 4, which is wider, thicker and longer than said casing. The grip 4 is made essentially from a yieldable, flexible material, that projects on all sides over the envelope surface of the casing 3 and is connected to the latter by yieldable material. The grip 4 is used for holding and operating the discharge apparatus 2. The casing 3 is squeezable and yieldable in a transverse direction with respect to the grip but is stiff and unyieldable in the longitudinal direction. The grips 4 of the discharge apparatuses 2 can be moved against one another in the set 1, so that for separation purposes they can easily be gripped and moved into a desired position.

The discharge apparatus 2 has a gas pump 5 in the form of a bellows pump, which has no folding bellows and which is essentially formed by the grip 4 or within the latter. The cushion-like pressure chamber 6 of the gas pump 5, which is approximately flat-oval in all cross-sections is formed by two facing outwardly spherical walls 7, 8 of squeezable and yieldable film material, which cannot be expanded by more than two, five or ten percent. The two film areas which are constructed in one piece by folding or can be formed by separate, foil portions placed upon one another, and connected to the outer circumference of the pressure chamber 6. The two film areas rest on one another in the vicinity of an edge 9 and are completely adhered over their whole area by welding, for example, so that the pressure chamber 6 is tightly sealed to the outside. Like virtually all the other components of the discharge apparatus, the pressure chamber 6 is symmetrical to a central axis 10 and is, compared with the width of the casing 3, at a much smaller distance from the associated end of said casing 3.

The pressure chamber 6 or the associated film balloon is connected by a neck 11 that has a much reduced width and thickness, relative to the associated end of the casing 3. At right angles to the central axis 10, the neck 11 has elongated flat cross-sections substantially constant over its length, which length is shorter than the greatest cross-sectional dimension and larger than the smaller cross-sectional dimension. The neck 11 defines an outlet channel 12 corresponding to its dimensions and is also formed by film portions 13, 14, which also form the walls 7, 8 of the pressure chamber 6.

In the vicinity of the walls 7, 8, these film portions 13, 14 also form the handles 15, 16, which are remote from one another and are outwardly spherically curved. In operation, the handles 15, 16 are pressed against one another between two or three fingers of one hand in such a way that the pressure chamber 6 is pressed flat and is emptied via the discharge channel 12 into the casing 3. The manufacturer places an original filling under pressure into the pressure chamber 6 and this secures the yieldable handles 4, 16 and the neck 11 in their expanded starting position in preparation for a single discharge operation, after which refilling is necessary.

The casing 3 is formed solely from two one-piece components, namely, an outer casing body 17 and a casing core 18 contained substantially or completely within the latter. The casing is connected without the use of separate connecting members directly to the grip 4 or the walls 7, 8 of the pressure chamber 6. One end of the outer casing body 17 is substantially closed by an end wall 19, whilst its other end is open to its full, remaining internal diameter. In the centre the end wall 19 is traversed by an outlet opening 20 of an atomizing nozzle 21 located on its outside. A medium outlet of atomizing nozzle 21 includes a nozzle pool or depression 22 and the outlet opening 20, which is located in the vicinity of the lowest point of the recessed nozzle pool depression 22, which is located in the outside of the end wall 19, depressed 22 having a much greater width than the outlet opening 20, and the depression 22 being surrounded by an approximately planar ring area of the end wall 19.

The casing core 18, which is narrower than the internal diameter of the casing body 17, is inserted from the open side of the casing body 17 into a centering recess 23, which is located at one end of the casing core 18 towards the end wall 19 and at a distance from its other end. The centering recess 23 is smaller in diameter than inner circumference 29. The centering recess 23 can be formed by radial or longitudinal ribs constructed in one piece with the casing body 17 and/or the casing core 18 and which project from the inner circumference 29 of the casing body 17. The casing core 18 is axially inserted into centering recess 23 and press fitted or seated in a secured position. The associated face 24 of the mandrel-shaped casing core 18 has a substantially constant external diameter over its entire length and is appropriately located the inside of the end wall 19 which limits its axial movement. In the vicinity of said faces is provided a whirling device 25 associated with the nozzle 21. When the medium mixture enters a portion of the nozzle channel that is widened in comparison with the outlet opening 20, the medium mixture rotates about the same central axis 10 as a result of transverse channels being formed between the faces and being directed approximately tangentially into the nozzle 21.

Between the outer circumference of the casing core 18 and the inner circumference of the casing body 17 there is a slot-like envelope space with a substantially constant slot width of less than 2 mm and in particular approximately 0.5 mm and said envelope space is subdivided by an overpressure valve 26, whose annular sealing lip 27 is closer to the front than to the rear end of the envelope space. The outer and/or inner circumference of the sealing lip 27 is widened in an approximately frustum-shaped manner under a cone angle of approximately 90° to the front end of the envelope space. The sealing lip 27 engages the opposite face with a cross-sectionally pitch circular, convexly rounded circular edge forming the closing face of said valve body.

The sealing lip 27 is constructed in one piece with the casing core 18 which is closed or solid in cross-section over its entire length and which projects over its otherwise continuous cylindrical outer circumference and at a limited distance behind the centering recess 23 with its closing face resiliently engaging the inner circumference 29 of the jacket 28 of the casing body 17. This inner circumference 29 also has substantially constant cylindrical cross-sections over the entire length of the casing jacket 28 or the envelope space. The thickness of the jacket 28 is of the same order of magnitude as the slot width of the envelope space or it can also be less than this.

The valve 26 can only open for delivery in the direction of the outlet opening 20 and resiliently closes or in constrained in a self-reinforcing manner with an opposite flow direction. The sealing lip 27 is axially fixed with respect to the casing body 17 and the casing core 18 except for its deformation movement. In the open state it frees an annular passage gap, which is much narrower than the width of the envelope space and forms an atomizing gap.

Between the closing face of the valve 26 and the rear end of the casing 3, the associated longitudinal portion of the envelope space forms a medium chamber 30 corresponding to its cross-sections. The medium chamber 30 is bounded at the front end by the outer, frustum-shaped flank of the sealing lip 27, which consequently forms a sloping guiding surface leading to the valve clearance when the valve is open. The faces 31 of the casing body 17 and the casing core 18 are located at the other end substantially in a common plane, the face of the casing core 18 being closed here in one piece, so that neither air nor medium from the pressure chamber can enter it. Both the faces 24, 31 are planar throughout.

The associated end of the medium chamber 30 that is roughly in the plane of the faces 31 forms a circular opening, which is roughly of the same width as the remaining medium chamber 30. The chamber 30 also forms inlet openings or an inlet 32 with two spaced, facing zones and by which the pressure chamber 6 is connected to the medium chamber 30 free from valves and closures. For this purpose the outlet channel 12 extends up to the faces 31.

For closing the circular opening between the inlets 32, the film portions 13, 14 which extend into the neck 11 form transverse, outwardly bent film parts 33, which are fixed adhesively, by welding, to both faces 31, and in this area sealingly cover the circular opening. The film parts 33 are positioned at right angles to the dividing plane 37 between the film portions 13, 14, in which are also located and interconnected their edges 9, so that the film parts 33 are provided transversely to the longer cross-sectional extension of the outlet channel 12.

The film parts 33 can be fixed in such a way that they are also maintained under the operating pressures which occur, from operation of the gas pump 5. The film parts 33 under said pressure are automatically detached from the faces 31 and consequently the previously closed zones of the circular opening are opened for forming a correspondingly larger inlet. In this case the film parts 33 could also completely close the circular opening in the starting state, so that a type of tear-off inlet valve is formed, which opens in a pressure-dependent manner. If at least one inlet 32 to the pressure chamber 6 or the outlet channel is also open in the starting state, then a transfer of the medium from the medium chamber 30 into the outlet channel 12 or into the pressure chamber 6 can be prevented. This occurs because the medium is relatively tightly packed in the medium chamber 30 or its capillary-like, small gap width, and the overpressure of the pressure chamber 6 at the inlets 32 contributes to permanently securing said medium in position.

Figure 3:
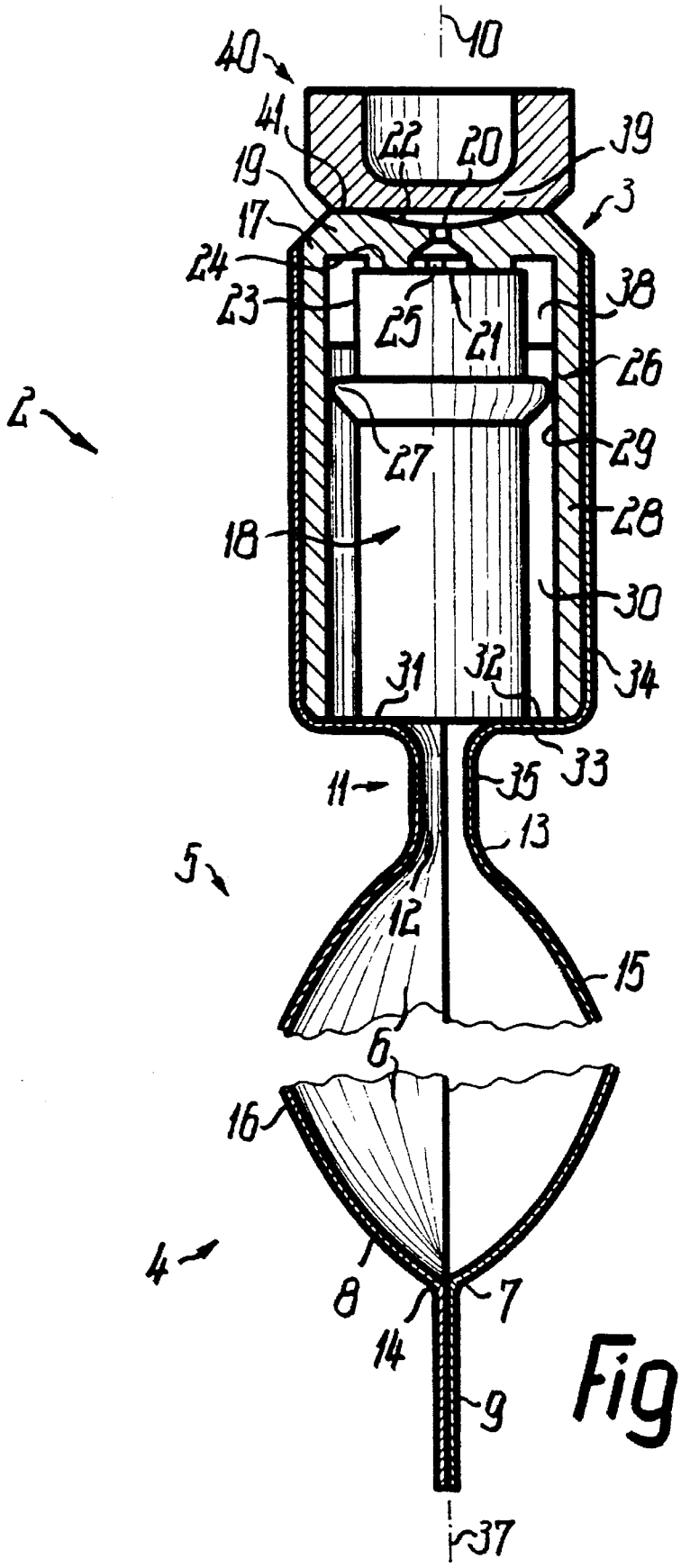
FIG. 3 is a second enlarged detail view in section of a single discharge apparatus according to FIG. 1.

The film parts 33 are placed round the associated terminal edge of the casing 3 or the casing body 17 on the outer circumference thereof. The film parts 33 envelop the circumference and/or the length thereof in substantially uninterrupted manner with film parts 34, so that the casing 3 is axially connected in pull-proof manner to the grip 4 or the gas pump 5. A joint 35 is created a result of i) the connection of the film portions 13, 14, ii) the cross-sectional shape of the neck 11, and iii) the stiffening action of the edges 9, which are connected in the manner of a marginal rib between the casing 3 and the grip 4 or the gas pump 5. a resilient bending joint of bending-slack. The joint 35 has flexible components reinforced by fluid pressure to pivot said two areas against one another from the central position according to FIG. 3 in the direction of both sides by at least 90° or more, i.e. in all by at least 180°. Admittedly there is also a slight pivoting which occurs parallel to the dividing plane 37, but the pivoting movement is mainly possible about a joint axis 36, which is roughly parallel to or in the dividing plane 37 and at right angles or transverse to the central axis 10 and intersecting the latter.

In the starting state, the outlet opening 20 or nozzle pool 22 on the outside of the discharge apparatus 2 or the casing 3 is closed in pressure-tight manner with a dimensionally stable closure 39, which is a component of a common, rod-like carrier 40 for the plurality of discharge apparatuses 2, forms the only connection between the particular discharge apparatus 2 and said carrier 40 and is constructed in one piece with the latter. For forming the closure the bending-elastic carrier 40 has a projection projecting flat over its profile side and which is fixed adhesively, e.g. by welding, by its face in whole-surface manner to the circular face of the casing 3 surrounding the outlet opening 20 or the nozzle pool 22, said fastening forming a predetermined breaking connection 31, which can be released without destruction of the casing 3 or its associated face.

In the vicinity of the closure projection the carrier 40 is provided on its side remote from the connection 41 with a cup-shaped depression, so that the end wall of the closure 39 used for closing purposes is flexible in relatively thin-walled manner and consequently allows for easier release from the casing 3 is slightly deformed in the manner of a hollow profile. The connection of the discharge apparatuses 2 to the carrier 40 is such that the discharge apparatuses 2 can be mounted in freely suspended manner with the carrier 40.

For the use of the discharge apparatus the latter is initially torn from the closure 39 or the carrier 40, so that the discharge opening 20 is opened. Then, the casing 3, manually held on the grip 4, is moved with the discharge opening 20 to the desired use point, e.g. is inserted into an opening and then the handles 15, 16 are compressed. Thus, the propellant flows out of the pressure chamber 6, via the inlets 32, into the filled medium chamber 30 until the opening pressure of the valve 26 is reached. The propellant then entrains the medium in preatomized manner into an intermediate chamber 38, which is formed between the whirling device 25 or the nozzle 21 and the valve 26 in the vicinity of the centering recess 23 by the front end of the envelope space. The chamber 38 can serve as a mixing or whirling chamber by its structuring with centring ribs and the like and in the starting state is empty or only gas-filled, which extends up to the transverse channels and forms between the latter and the medium chamber 30 a portion of a discharge channel.

From said intermediate chamber 38 the mixture of the active substance and the propellant passes via the whirling device 25 into the nozzle 21 and from there through the outlet opening 20 into the open. Following the single use, during which the medium is substantially completely discharged from the medium chamber 30, the complete discharge apparatus 2 can be thrown away or can be recycled to recover its materials. All the individual components are made from materials or plastics, which are jointly suitable for recycling to a plastic starting product.

The passage cross-sections of the outlet channels 12 can be roughly the same as the passage cross-sections of the medium chamber 30 or can be larger than the latter. The passage cross-sections of the intermediate chamber 38 are roughly the same or smaller than those of the medium chamber 30. In the open state the passage cross-sections of the valve 26 are much smaller. The passage cross-sections of the transverse channels or the whirling device 25, nozzle 21 and outlet opening 20 are much smaller than the aforementioned passage cross-sections. The discharge apparatus is also suitable for filling the pressure chamber 6 and the medium chamber 30 with the same medium or to leave the medium chamber unfilled in the starting state and to only store the medium to be discharged in the pressure chamber and said medium only enters the chamber 30 during the discharge actuation.

Each of the mentioned configurations, parts, units, spaces or functions can be provided in only a single occurrence or in a plurality of two or more, for example to provide successive and/or simultaneous multiple media discharge of similar and/or different media through a single and/or a plurality of outlets.

I claim:

1. A dispenser for discharging media comprising:

a medium outlet (20);

a medium reservoir providing a medium chamber (30) at least partly emptyable via said medium outlet (20), and a propellant pump (5) having a pressure chamber (6), said pressure chamber (6) being at least partly separated from said medium chamber (30), and in an initial state said pressure chamber (6) enclosing a propellant;

said propellant pump (5) providing a manually operable pump, means being provided for pressing said propellant in said pressure chamber (6) against medium contained in said medium chamber (30), wherein said medium chamber (30) is provided as an annular reservoir space bounded by circumferential faces including outer and inner circumferential faces, and wherein an annular closure (27) is situated in a closed position between said circumferential faces at an outlet end of said annular reservoir space, said annular closure (27) being movable to an open position by an increase in pressure in said reservoir space (30) that allows passage of the medium past the annular closure (27), while the inner and outer circumferential faces remain positionally stable in relation to each other.

2. The dispenser according to claim 1, wherein said dispenser is operable over a discharge stroke and in said initial state said pressure chamber (6) is substantially sealingly closed with respect to said medium chamber (30), said pressure chamber (6) being opened with respect to said outlet (20) as a function of said discharge stroke of said dispenser (2).

3. The dispenser according to claim 2, wherein in said initial state said pressure chamber (6) contains a volume of said propellant, and said medium chamber contains a volume of medium, said pressure chamber being sized in relation to said medium chamber such that the volume of propellant is at least 100 to 200 times greater than said volume of said medium said pressure chamber containing a volume of propellant that is variable as a function of said discharge stroke of said dispenser, said pressure chamber (6) being at least partly emptyable through said medium chamber (30) and said medium contained in said medium chamber (30).

4. The dispenser according to claim 3, wherein said pressure chamber (6) has at least one wall (7, 8) of substantially stable dimension, and in said initial state, said wall of said pressure chamber (6) is under tensile stress provided by internal filling pressure.

5. The dispenser according to claim 1, wherein said pressure chamber (6) has at least one chamber wall (7, 8), said chamber wall (7, 8) being at least partly flexible, said chamber wall (7, 8) being at the most only slightly elastic, said medium chamber (30) being a provided by a dimensionally stable casing (3) substantially entirely enclosed within said chamber wall (7,8).

6. The dispenser according to claim 1, wherein said pressure chamber (6) has at least two chamber walls (7, 8), at least one of said walls (7, 8) being substantially inelastic but flexible, said chamber walls (7, 8) being curved to an outside of said pressure chamber (6), and in the initial state said pressure chamber (6) providing a flattened cushion.

7. The dispenser apparatus according to claim 1, wherein said pressure chamber (6) is formed by opposing foil sections (13, 14), said opposing foil sections (13, 14) being fixedly connected in a marginal area outside said pressure chamber (6) in firmly adhering, web-forming manner.

8. The dispenser according to claim 1, wherein said pressure chamber (6) is elongated in a direction substantially parallel to said media outlet (20).

9. The dispenser according to claim 1, wherein said pressure chamber (6) has at least one flexible wall (7, 8) defining an outside, two remote handles (15, 16) being provided for discharge actuation, at least one of said handles (15, 16) being directly formed by substantially all of said outside of said flexible wall (7, 8), at least one of said handles (15, 16) providing a convex pressure surface substantially as large as a ball of a human's thumb.

10. The dispenser according to claim 1, wherein said propellant pump (5) is located upstream of said medium chamber (30), in operation said medium chamber (30) providing an annular outlet channel (38) for dispensing said medium to said medium outlet (20).

11. The dispenser according to claim 1, wherein said medium chamber (30) and said pressure chamber (6) define at least one central axis (10), said medium chamber (30) being provided by a dimensionally stable casing (30) having an end face (31), said medium chamber (30) having at least one propellant inlet (32) substantially located in said end face (31), said propellant inlet (32) being spaced from said central axis (10), said medium chamber (30) providing a chamber outlet closed by said closure (27), said chamber outlet leading to said medium outlet (20), said chamber outlet being spaced from said at least one propellant inlet (32) and said medium outlet (20).

12. The dispenser according to claim 1, wherein said medium outlet (20) has an outlet opening defined by a boundary, said medium chamber (30) and said boundary being at least partly dimensionally stable under operational conditions.

13. The dispenser according to claim 1, wherein said medium chamber (30) and said medium outlet (20) are formed by at least one casing (3), said casing (3) being flexible about a single axis (36) with respect to said propellant pump (5) and at least one holder grip (4) being provided for manually holding said dispenser (2) in said initial state.

14. The dispenser according to claim 1, wherein said medium chamber (30) defines a central chamber axis (10), said medium chamber (30) is arranged about said chamber axis (10), and said medium chamber (30) is at least partly annular.

15. The dispenser according to claim 1, wherein said medium chamber (30) has remote first and second ends, said remote first end being directly connected to said pressure chamber (30) free of any separate tube connection, said remote second end being connected to said medium outlet (20) via an outlet channel and a whirling device (25).

16. The dispenser according to claim 1, wherein said medium chamber (30) has a chamber opening (32) and said pressure chamber (6) has a chamber wall, said chamber opening being at least partly closed by said chamber wall.

17. The dispenser according to claim 1, wherein said propellant pump (5) has chamber wall (7, 8), said propellant pump (5) having outlet channel (12) constricted with respect to said pressure chamber (6), casing (3) being provided and having an end face (31), at least one section of said chamber wall (7, 8) having an angled shape and at least partly covering said end face (31).

18. The dispenser according to claim 1, wherein said medium chamber (30) is prefilled with fluid to be discharged substantially free of remaining space, said medium chamber (30) having at least one propellant inlet (32) and said medium chamber (30) having at least one chamber outlet, said fluid being at least partly positionally secured in said medium chamber (30) by a pressure in said pressure chamber (6) and an outlet valve (26).

19. The dispenser according to claim 1, wherein a valve (26) is provided, said valve (26) having a valve body providing a frustum-shaped sealing lip (27) sealingly and resiliently engaging a circumferential surface (29) of said medium chamber (30), said valve (26) being provided by a component (18) bounding in positionally rigid manner said medium chamber (30).

20. The dispenser according to claim 1, wherein said medium chamber (30) is bounded by an outer, substantially cup-shaped casing body (17) receiving a casing core (18) substantially coaxially and in centered manner, said casing core (18) providing a mandrel, said casing core (18) having an outer circumference, and a sealing lip (27) projecting on said outer circumference.

21. The dispenser according to claim 1, wherein a casing core (18) is provided, said casing core (18) bounding a cross channel (25) transverse with respect to said medium outlet (20), and said casing core (18) connecting substantially directly to said pressure chamber (6).

22. The dispenser according to claim 1, wherein said chamber (30) is provided by a casing space, said casing space being subdivided into at least two division chambers (30, 38) by a closure membrane (27), one of said two division chambers providing said medium chamber (30) and another of said two division chambers providing an entry chamber (38) substantially free of the medium in said initial state.

23. The dispenser according to claim 1, wherein a dispensing unit (2) and a casing (3) are provided, said pressure chamber (6) providing a wall (7, 8) and a neck (11), said wall (7, 8) providing a closure section (33) for releasably closing a connecting duct provided between said pressure chamber (6) and said medium chamber (30).

24. The dispenser according to claim 1, wherein a dispensing unit (2) is provided, said dispensing unit holding a prefilled volume of at least one of said medium and said propellant, said outlet (20) penetrating an outlet face (41) in the vicinity of an outside of said dispensing unit (2), said prefilled volume being prevented from escaping to said outside by a closure (39), said closure (39) separably covering said outlet face (41) and having connections thereto, and means being provided for opening said closure (39) by mechanically transmitting a manual opening motion from said outside to said closure (39) to interrupt said connections between said closure (39) and said outlet face (41).

25. The dispenser according to claim 1, wherein a plurality of dispensing units (2) are provided, at least two of said dispensing units (2) being provided on at least one elongated carrier (40), said dispensing units (2) freely extending from said carrier (40), at least one of said dispensing units (2) being at least partly separable from said carrier (40) by breaking off.

26. A dispenser for discharging media, comprising:

a medium outlet (20);

a medium chamber (30) providing a medium reservoir and bounded by reservoir walls; and a pump (5) having a pump chamber (6) separate from said medium chamber (30) but connectable with said medium chamber (30) for discharge operation, said pump chamber (6) being bounded by cheer walls (7, 8) separate from said reservoir walls, wherein said pump walls (7, 8) envelope said reservoir walls (28) providing a reservoir circumference defining an overall length extension, said pump walls (7, 8) uninterruptedly engaging said reservoir circumference over most of said overall length extension.

27. A dispenser for discharging media comprising:

a basic casing (17);

a medium outlet (20);

a medium chamber (30) providing a medium reservoir and bounded by reservoir walls, said medium reservoir defining a main central axis (10) and having reciprocally spaced first and second open reservoir ends, and closure means substantially sealingly closing said medium reservoir at one of said reservoir ends, wherein said medium reservoir is spaced about said central axis (10), a central core body (18) being provided radially inside said medium reservoir and being fixedly connected to said basic casing (17), said closure means (26) providing an annular, resilient sealing lip (27), said sealing lip (27) extending from said core body (18) and sealingly but releasably engaging an inner circumference (29) of said basic casing (17);

a pump (5) having a pressure chamber (6), said pressure chamber (6) being at least partly separated from said medium chamber (30), with means (35) forming a passageway from said pressure chamber (6) to said medium chamber (30), and in an initial state said pressure chamber (6) enclosing a propellant; and said pump (5) providing a manually operable pump, means being provided for pressing said propellant in said pressure chamber (6) through said passageway and against medium contained in said medium chamber (30).

28. A dispenser for discharging media, comprising:

a basic casing (17) having two casing faces oriented at angles with respect to each other to define end face (31) and the outer circumferential face of jacket (28);

a medium outlet (20);

a medium chamber (30) providing a medium reservoir and bounded by reservoir walls, said medium reservoir defining a main central axis (10) and having reciprocally spaced and open first and second reservoir ends, and closure means (26, 33) at least partly closing said medium reservoir at one of said reservoir ends, wherein said closure means provides a flexible closure wall (33) covering said two casing faces;

a pump (5) having a pressure chamber (6), said pressure chamber (6) being at least partly separated from said medium chamber (30), with means (35) forming a passageway from said pressure chamber (6) to said medium chamber (30), and in an initial state said pressure chamber (6) enclosing a propellant; and said pump (5) providing a manually operable pump, means being provided for pressing said propellant in said pressure chamber (6) through said passageway and against medium contained in said medium chamber (30).

29. A dispenser for discharging media, comprising:

a dispenser casing (3) providing casing walls;

a medium outlet (20) traversing said dispenser casing (3);

a medium chamber (30) providing a medium reservoir and bounded by said casing walls, said medium reservoir having remote inlet and outlet ends (32,27), and an outlet duct (38) connecting said medium reservoir with said medium outlet (20), wherein said dispenser casing (3) is assembled from exclusively two first and second casing components (17, 18) being in one part, said first casing component (17) substantially being a cup, said second casing component being a core body (18) inserted in and substantially fixedly connected to said first casing component (17), said first and second casing components (17, 18) commonly bounding said medium reservoir (30), one of said casing components (17) providing said medium outlet (20);

a pump (5) having a pressure chamber (6), said pressure chamber (6) being at least partly separated from said medium chamber (30), with means (35) forming a passageway from said pressure chamber (6) to said medium chamber (30), and in an initial state said pressure chamber (6) enclosing a propellant;

said pump (5) providing a manually operable pump, means being provided for pressing said propellant in said pressure chamber (6) through said passageway and against medium contained in said medium chamber (30).

30. A dispenser for discharging media, comprising:

a medium outlet (20) defining an outlet width extension;

said dispenser also having an outlet face (22) traversed by said medium outlet (20), said outlet face (22) having an outer width extension greater than said outlet width extension, said dispenser also having an annular end face surrounding said outlet face (22);

a medium chamber (30) providing a medium reservoir;

closure means (40) closing said medium outlet (20), wherein said closure means provide a closure member (39) separate from said outlet face (22), said closure member (39) being adhesively connected to said annular end face, means being provided for opening said medium outlet (20) by disrupting said closure member (39) from said annular end face; and means for expelling a medium from said medium reservoir through said medium outlet after it is opened.

31. The dispenser according to claim 30, wherein said outlet face (22) is depressed with respect to said annular end face, said closure means (40) being configured for dimensional stability.

32. A dispenser for discharging media, comprising:

a medium outlet (20) for dispensing the medium out of said dispenser (2);

a dimensionally, substantially stable dispenser casing (3) provided by an outer hollow casing body (17) and a core body (18) fixedly inserted in said casing body (17), said casing body (17) being cup-shaped and having an external end wall (19), said end wall (19) being traversed by said medium outlet (20), said core body (18) connecting to an inside of said end wall (19);

a medium chamber (30) providing a medium reservoir, said medium reservoir being commonly bounded by said casing body (17) and said core body (18), said medium reservoir providing an inlet (32) at a casing end (31) of said dispenser casing (3), said casing end (31) being located remote from said medium outlet (20), and a pump (5) providing a flexible pump balloon being connected to said dispenser casing (3), said pump (5) providing an outlet duct (12) connected to said inlet (32), said pump (5) providing a pump chamber (6) bounded by a pump wall (7, 8), said pump wall (7, 8) providing a wall section (33, 34) fixedly connecting said pump (5) to said dispenser casing (3) at said casing end (31), said wall section (34) enveloping said dispenser casing (3).

33. A dispenser for discharging medium comprising:

a carrier (40);

a plurality of interconnected units (2) individually and independently separable from said carrier (40), said plurality of units (2) providing a dispenser unit (2) including a medium reservoir (30), a medium outlet including an outlet opening (20) and a pump (5), wherein said at least one of said operable units (2) and said carrier (40) have first and second end faces respectively, that are adhesively interconnected to form an adhesive break-off connection (41), said at least one operable unit (2) being separable from said carrier (40) without destruction; and means for expelling a medium from said medium reservoir through said medium outlet after it is opened; and wherein said medium outlet forms a depression (22) having a bottom wherein said outlet opening (20) is located, said outlet opening (20) being surrounded by said first end face.

34. The dispenser according to claim 33, wherein said first end face surrounds said outlet opening (20), said first end face being annular and substantially planar, and wherein said second end face provides a closure on said outlet opening (20).

35. The dispenser according to claim 34, further comprising an atomizing nozzle (21), and wherein said atomizing nozzle opens through said outlet opening (20) and said depression (22).

* * * * *

UNITED STATES PATENT AND TRADEMARK OFFICE

CERTIFICATE OF CORRECTION

PATENT NO. : 5,482,193

DATED : January 9, 1996

INVENTOR(S) : Fuchs, Karl-Heinz

It is certified that error appears in the above-identified patent and that said Letters Patent is hereby corrected as shown below:

Item [57]

Line 12 of Abstract, "39" should be --(39)--.

Line 13 of Abstract, "21" should be --(21)--.

Column 1, line 16, "reduces" should be --reduce--.

Column 1, line 48, after "propellant" insert --is--.

Column 1, line 57, delete "l".

Column 2, line 63, after "which" insert --is--.

Column 3, line 7, after "Fig. 1" insert --; and--.

Column 3, line 51, delete "or".

Column 4, line 24, "centre" should be --center--.

Column 4, line 48, after "located" insert --on--.

Column 5, line 16, "in" should be --is--.

Column 6, line 12, after "created" insert --as--.

Column 8, line 18, delete "a".

Column 9, line 47, "a cross" should be --across--.

Column 10, line 24, "cheer" should be --chamber--.

UNITED STATES PATENT AND TRADEMARK OFFICE

CERTIFICATE OF CORRECTION

PATENT NO. : 5,482,193

DATED : January 9, 1996

INVENTOR(S) : Fuchs, Karl-Heinz

It is certified that error appears in the above-identified patent and that said Letters Patent is hereby corrected as shown below:

Column 10, line 41, "being" should be --having--.

Column 12, line 50, "outlet" should be --medium--.

Signed and Sealed this

Twelfth Day of November, 1996

Bruce Lehman

*Attest:*

BRUCE LEHMAN

*Attesting Officer*

*Commissioner of Patents and Trademarks*